United States Patent [19]

Wan-Li

[11] Patent Number: 5,022,118

[45] Date of Patent: Jun. 11, 1991

[54] LADDER JOINT WITH ENGAGEMENT SPRING MEMBER

[75] Inventor: Chang Wan-Li, Taipei, Taiwan

[73] Assignee: Wan Dean Industry Co., Taiwan

[21] Appl. No.: 542,771

[22] Filed: Jun. 25, 1990

[51] Int. Cl.[5] ..... E05D 11/10

[52] U.S. Cl. ..... 16/327; 16/332; 16/334; 16/349; 182/163; 403/93; 403/96

[58] Field of Search ..... 16/324–327, 16/332, 349, 334; 403/93, 96; 182/163

[56] References Cited

U.S. PATENT DOCUMENTS

| | | | |
|---|---|---|---|
| 3,643,292 | 2/1972 | Mayer | 16/325 |
| 4,474,264 | 10/1984 | Krause | 16/349 |
| 4,577,986 | 3/1986 | Wang | 16/349 |
| 4,645,371 | 2/1987 | Wang | 16/332 |
| 4,805,737 | 2/1989 | Peng | 16/332 |
| 4,925,329 | 5/1990 | Chuang | 16/332 |

FOREIGN PATENT DOCUMENTS

| | | | |
|---|---|---|---|
| 967126 | 5/1975 | Canada | 16/326 |

*Primary Examiner*—Richard K. Seidel
*Assistant Examiner*—Edward A. Brown
*Attorney, Agent, or Firm*—Steinberg & Raskin

[57] ABSTRACT

A ladder joint with an engagement spring member on it for locking/unlocking the ladder joint into position. The ladder joint has a fixed member and a movable member. The movable member has a circular portion with fixing slots on its outer circumference. The fixed member has an annular track which slidably receives the circular portion of the movable member. Both the fixed and the movable members have a straight portion for connecting with the ladder pieces. The engagement spring member is a rounded flat spring which has an extended edge on one of its ends which normally spring loads the rectangular slug into one of the fixing slots as set by the user.

1 Claim, 4 Drawing Sheets

LADDER JOINT WITH ENGAGEMENT SPRING MEMBER

BACKGROUND OF THE PRESENT INVENTION

The present invention generally relates to ladders and more particularly relates to a ladder joint incorporating an engagement spring member to fix the angular orientation of the ladder.

In the past, locking mechanisms for ladders were complicated and, due to their complicated structure, relatively expensive to manufacture.

It is the purpose of this present invention, therefore, to mitigate and/or obviate the above-mentioned drawbacks in the manner set forth in the detailed description of the preferred embodiment.

SUMMARY OF THE PRESENT INVENTION

A primary objective of the present invention is to provide a ladder joint having a simple and sturdy engagement spring member for locking the angle of the ladder in place.

Another objective of the present invention is to provide such as engagement spring member which is inexpensive to manufacture.

Still another objective of the present invention is to provide such an engagement spring member which is easy to use.

These and additional objectives, if not set forth specifically herein, will be readily apparent to those skilled in the art from the detailed description provided hereinbelow, with appropriate reference to the accompanying drawings.

DETAILED DESCRIPTION OF THE DRAWINGS

DETAILED DESCRIPTION OF THE PREFERRED EMBODIMENT

Figure 1:
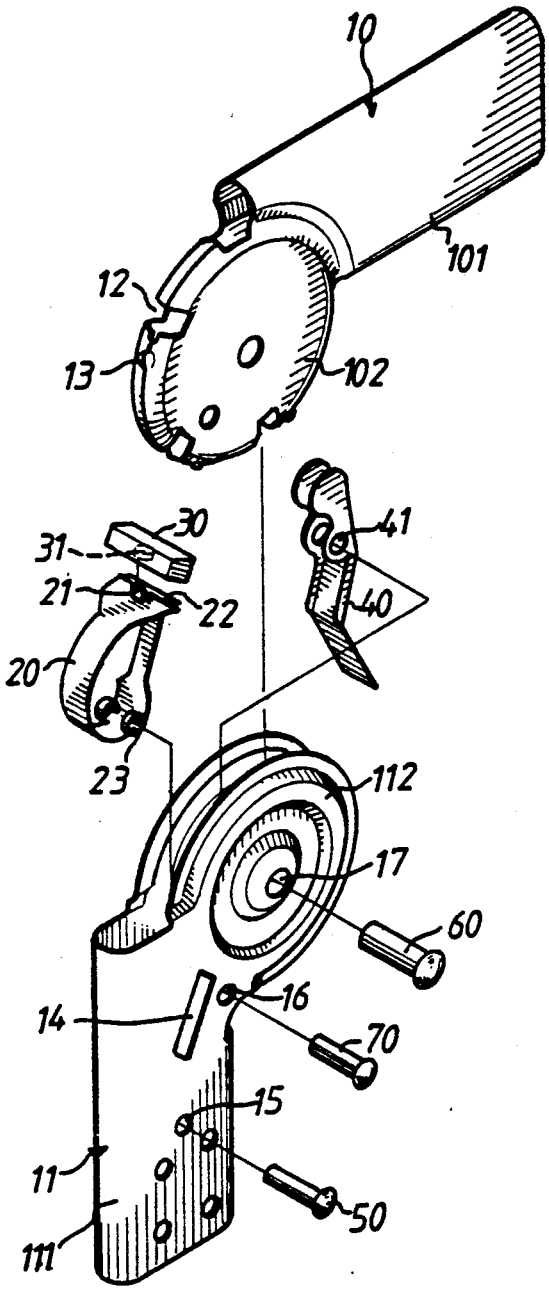
FIG. 1 is an exploded view of a ladder joint with an engagement spring member in accordance with the present invention.

Referring to FIGS. 1–4, and initially referring to FIG. 1, the ladder joint with engagement spring member in accordance with the present invention will now be explained in detail.

In accordance with the present invention, the ladder joint with engagement member comprises the combination of a fixed member 11, a movable member 10, an engagement spring member 20, a slug 30 with a recess 31 and a release latch 40.

The fixed member 11 comprises an integrally connected hollow straight portion 111 and an annular track portion 112, with the annular track portion 112 having a central axial hole 17 therethrough. The straight portion 111 has an adjustment slot 14 thereon, and the fixed member 11 has a rivet hole between the straight portion 111 and the annular track portion 112 for receiving a securement rivet 70. An aperture 15 is set in the straight portion and a spring member rivet is fixed in the aperture 15.

The movable member 10 comprises two portions which are integrally connected, the hollow straight portion 101 and the circular portion 102. A plurality of fixing slots 12 are positioned evenly around an outer circumference of the circular portion 102, with a plurality of respective protuberances 13 being positioned proximate to each of the fixing slots 12, for locating said fixing slots 12.

The engagement spring member 20 has a flat portion and a curved portion. At a junction portion of the flat and curved portions there are provided securement loops 23 for fixing the engagement spring 20 proximate to the aperture 15 via the spring member rivet 70. The flat portion has an extended edge 22 on an end remote to the junction portion. The curved portion ends as a broader curved plate and has a protuberant tab 21 thereon for inserting into the recess 31 of the slug 30.

Figure 2:
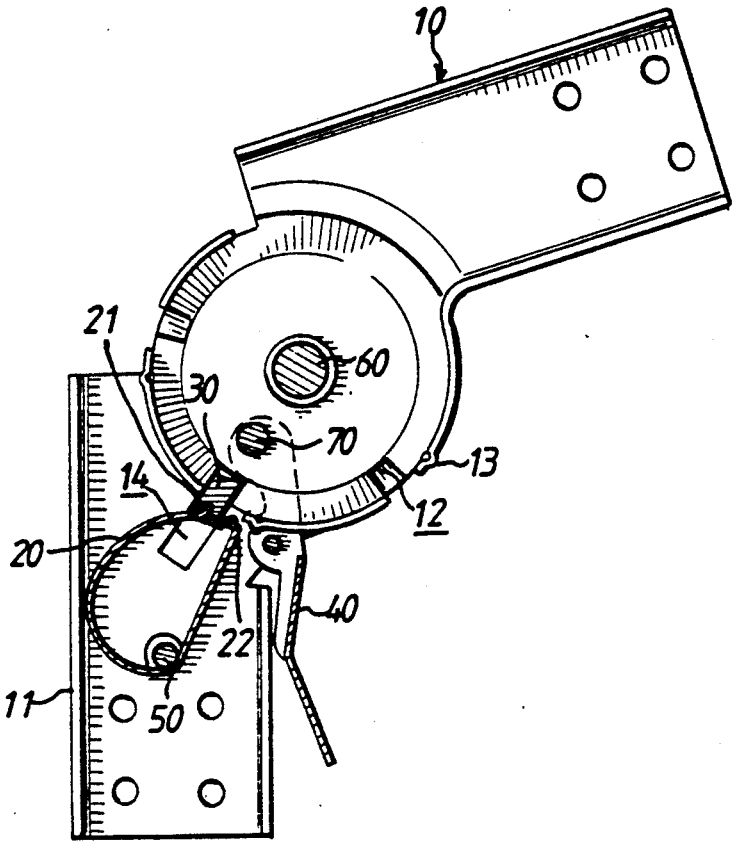
FIG. 2 is an elevational cutaway view of the ladder joint with engagement spring member of FIG. 1, showing the release latch and slug is engaged (locked) position.
Figure 3:
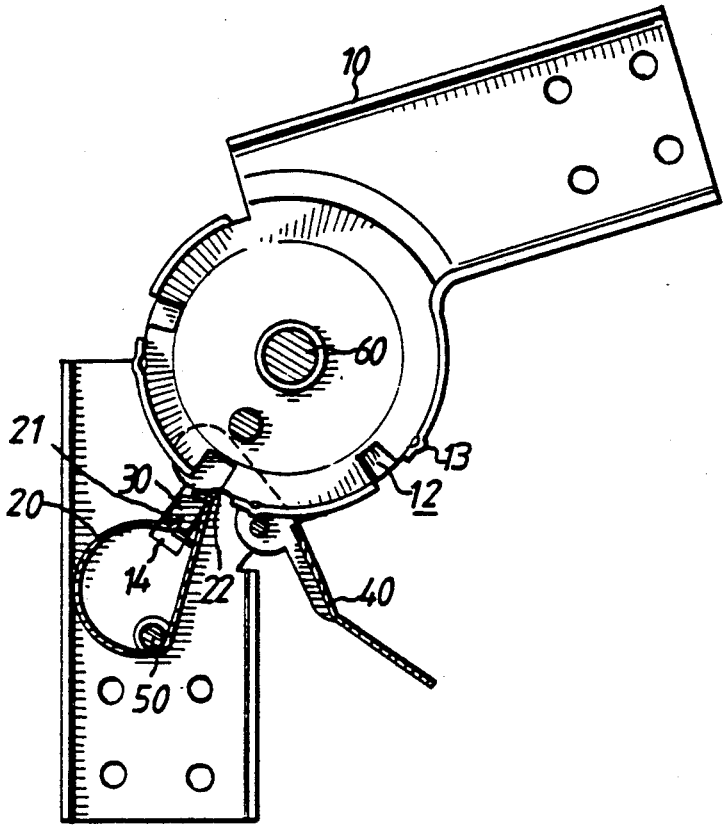
FIG. 3 is an elevational cutaway view similar to FIG. 2, showing the release latch and slug in disengaged (unlocked) position, but ready to be put into engaged position.
Figure 4:
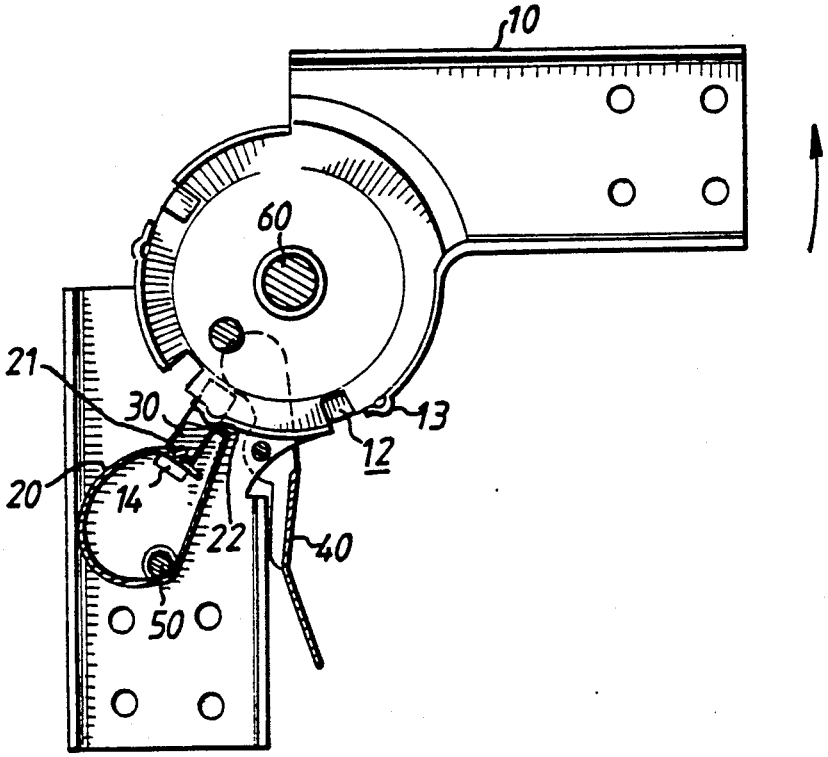
FIG. 4 is an elevational cutaway view similar to FIG. 2, showing the slug being retained in disengaged position by a protuberance.

As seen in FIGS. 2 through 4, the rectangular slug 30 is slidable in the adjustment slot 14 for engaging with the fixing slots 12. Normally, the ladder joint in accordance with the present invention is locked in position; that is, after the movable member 10 is rotated in a counter-clockwise direction, the extended edge 22 of the engagement spring 20 on a surface of the slug 30 is pushed away by the protuberance 13 on the circumference of the circular portion 102. The engagement spring member 20 urges the slug 30 into ne of the engagement slots 12. The release latch 40 has a flat end, a curved end and pivot holes 41 thereon. A securement rivet 70 pivotally fixes the release latch 40 at the rivet hole 16 through the pivot holes 41 thereof. The curved end normally is urged against the slug 30 by the engagement spring member 20.

To disengage the movable member 10, the flat end of the release latch 40 is pulled by the user which simultaneously presses the slug 30 out of the fixing slot 12, the slug 30 is held at a retracted position as best illustrated by FIG. 3.

While the present invention has been explained in relation to its preferred embodiment, it is to be understood that various modifications thereof will be apparent to those skilled in the art upon reading this specifications. Therefore, it is to be understood that the invention disclosed herein is intended to cover all such modifications as shall fall within the scope of the appended claims.

I claim:

1. In a ladder joint comprising the combination of:

a fixed member having an adjustment slot, a rivet hole and an aperture;

a release latch pivotally mounted to the rivet hole of the fixed member; and a movable member having a plurality of fixing slots position evenly around an outer periphery thereof, and having a plurality of respective protuberances on said outer periphery each adjacent to a corresponding fixing slot; the improvement comprising a means for effecting a change in angular position between said fixed member and said movable member comprising:

an engagement spring member having a hooking piece at one curved end thereof, an extended edge at the other end thereof, and a pair of securement loops at an intermediate portion thereof for mounting to the aperture of the fixed member; and a substantially rectangular slug having a recess on a side thereof for receiving said hooking piece and being disposed in the adjustment slot of the fixed member, said slug being movable by said curved end of aid engagement spring member, upon a sideward movement of said extended edge caused by contact with one of the protuberances of the movable member, to slide into one of said plurality of fixing slots of the movable member to prevent a relative rotation between the fixed and movable members.

* * * * *